US005885067A

United States Patent [19]

Jang

[11] Patent Number: 5,885,067

[45] Date of Patent: Mar. 23, 1999

[54] METHOD FOR DISPLAYING A POSSIBLE REMAINING TIME OF A COMBUSTION OPERATION IN A COMBUSTION APPLIANCE AND APPARATUS THEREFOR

[75] Inventor: Kil-Soo Jang, Seoul, Rep. of Korea

[73] Assignee: Daewoo Electronics Co., Ltd., Seoul, Rep. of Korea

[21] Appl. No.: 772,746

[22] Filed: Dec. 23, 1996

[30] Foreign Application Priority Data

Dec. 29, 1995 [KR] Rep. of Korea ..... 1995-65107

[51] Int. Cl.[6] ..... F23N 5/08; G08B 17/12; G01F 1/00

[52] U.S. Cl. ..... 431/2; 431/13; 431/18; 73/861

[58] Field of Search ..... 431/13, 14, 18, 431/2; 73/861, 198

[56] References Cited

U.S. PATENT DOCUMENTS 4,262,530 4/1981 Gerquest ..... 73/861.8
5,270,684 12/1993 Faraci, Jr. ..... 431/79

*Primary Examiner*—Carl D. Price
*Attorney, Agent, or Firm*—Beveridge, DeGrandi, Weilacher & Young LLP

[57] ABSTRACT

A method of displaying a possible remaining time of a combustion operation in a combustion appliance and an apparatus thereof are disclosed. The combustion appliance has a fuel tank for containing fuel, a burner for performing the combustion operation of the fuel supplied from the fuel tank, and an electromagnetic pump for supplying the fuel in the fuel tank to the burner. A microprocessor gauges a quantity of the fuel in the fuel tank, and calculates a total heat amount according to the quantity of the residual fuel. Also, the microprocessor calculates the heat supply amount per time on the basis of the driving frequency of the electromagnetic pump. The possible remaining time of the combustion operation is calculated by dividing the total heat amount by the heat supply amount per time. The microprocessor displays the possible remaining time of the combustion operation to the exterior of the combustion appliance through the display part. Accordingly, it is possible to calculate the possible remaining time of the combustion operation exactly, and the convenience of using of the combustion appliance is provided to the users.

7 Claims, 3 Drawing Sheets

METHOD FOR DISPLAYING A POSSIBLE REMAINING TIME OF A COMBUSTION OPERATION IN A COMBUSTION APPLIANCE AND APPARATUS THEREFOR

BACKGROUND OF THE INVENTION

1. Field of the Invention

The present invention relates to a method for displaying a possible remaining time of a combustion operation in a combustion appliance and apparatus therefor, and more particularly, to a method for calculating a remaining time capable of performing combustion operation with a residual fuel and displaying said remaining time exactly and an apparatus therefor.

2. Prior Art

Generally, a combustion appliance like a fan heater or a rotary heater performs a combustion operation by using a liquid fuel, for example, a petroleum. The combustion appliance has a fuel tank for containing a fuel, and a burner for performing the combustion operation by burning the fuel supplied from the fuel tank. Such a conventional combustion appliance is shown in FIG. 1. The fuel 80 is contained in the fuel tank 90, and an electromagnetic pump 20 for supplying the burner 65 with the fuel 80 is disposed on the upper side of the fuel tank 90. At the upper/lower part of the electromagnetic pump 20, a suction pipe 70 connected to the fuel tank 90 and a transfer pipe 60 connected to the burner 65 are installed respectively. When the electromagnetic pump 20 operates, the fuel 80 in the fuel tank 90 is drawn through the suction pipe 70 and supplied to the burner 65 through the transfer pipe 60. An oil gauge 30 for gauging the quantity of the fuel 80 in fuel tank 90 is mounted on one side of the fuel tank 90.

However, the conventional combustion appliance has a problem that the user of the combustion appliance cannot ascertain the possible remaining time of combustion operation by the residual fuel 80 in the fuel tank 90. That is, since the conventional combustion appliance only has a function displaying the quantity of the residual fuel 80 in fuel tank 90 through the oil gauge 30, the user knows the quantity of the residual fuel 80 but doesn't know the remaining time capable of performing combustion operation in correlation with the quantity of the residual fuel 80. Therefore, the user estimates the possible remaining time of combustion operation according to his experience, so it is difficult to determine the pertinent time to refill the fuel tank 90 with the fuel 80. Specifically, since the possible remaining time of combustion operation differs greatly according to the consumption quantity of the fuel 80 per time, when the user increases or decreases the intensity of combustion operation, it is more difficult to estimate the possible remaining time of combustion operation.

SUMMARY OF THE INVENTION

The present invention has been proposed to overcome the above described problems in the prior art, and accordingly it is an object of the present invention to provide a method of displaying the possible remaining time of combustion operation according to the quantity of a residual fuel in a fuel tank in a combustion appliance.

Also it is another object of the present invention to provide an apparatus for displaying the possible remaining time of combustion operation according to the quantity of a residual fuel in a fuel tank.

To achieve the above object, the present invention provides a method of displaying a possible remaining time of a combustion operation in a combustion appliance which has a fuel tank for containing a fuel, a burner for performing the combustion operation of the fuel supplied from said fuel tank, and an electromagnetic pump for supplying the fuel in said fuel tank to said burner, comprising the steps of: gauging a quantity of the fuel in said fuel tank; calculating a fuel supply quantity per time of the fuel supplied to said burner on the basis of a driving frequency of said electromagnetic pump; determining the possible remaining time of the combustion operation according to the quantity of the fuel and the fuel supply quantity per time; and displaying the possible remaining time of the combustion operation.

It is preferable that the fuel supply quantity per time is proportional to a driving frequency of said electromagnetic pump, and the possible remaining time of combustion operation is displayed when the combustion operation of said burner is being performed.

Also, it is possible to calculate a heat supply amount per time on the basis of the driving frequency of the electromagnetic pump, and to determining the possible remaining time of combustion operation by dividing a total heat amount according to the quantity of the residual fuel by the heat supply amount per time.

Furthermore, according to the present invention, an apparatus of displaying a possible remaining time for a combustion operation in a combustion appliance performing such a method of displaying a possible remaining time of combustion operation is provided.

BRIEF DESCRIPTION OF THE DRAWINGS

The present invention will be better understood and its various objects and advantages will be more fully appreciated from the following description taken in conjunction with the accompanying drawings, in which.

DETAILED DESCRIPTION OF THE PREFERRED EMBODIMENTS

Hereinafter, the present invention will be described in detail with reference to the drawings.

Figure 1:
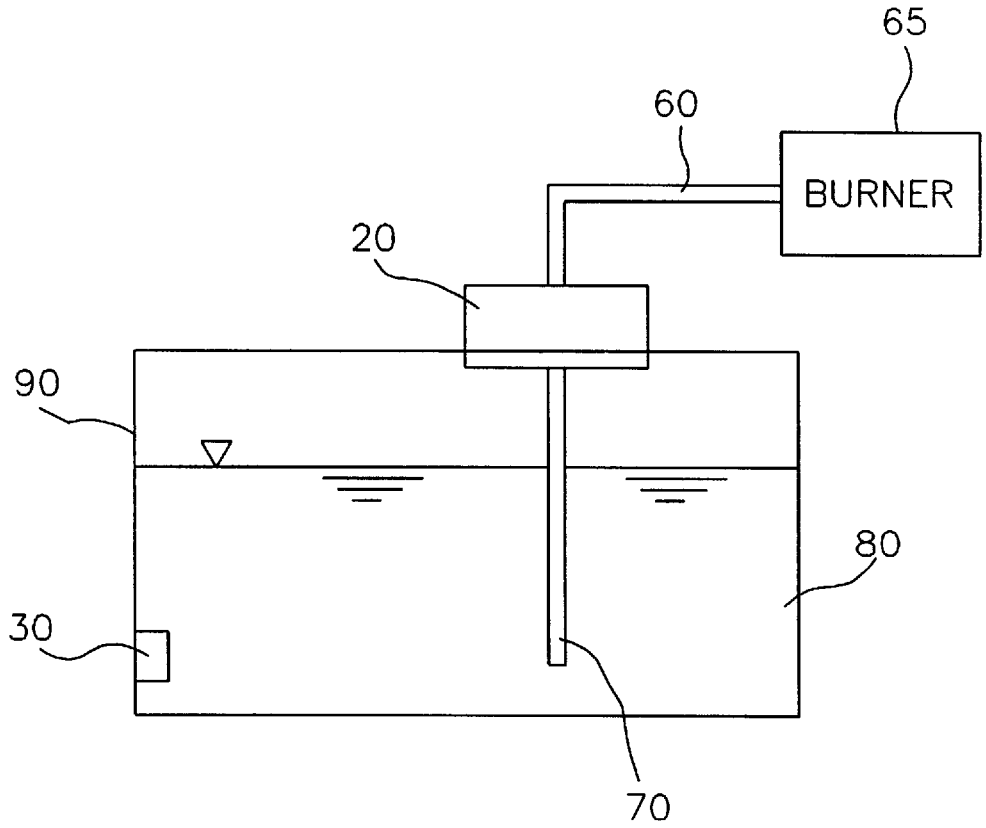
FIG. 1 PRIOR ART
FIG. 1 is a schematic view of a fuel tank in a conventional combustion appliance.
Figure 2:
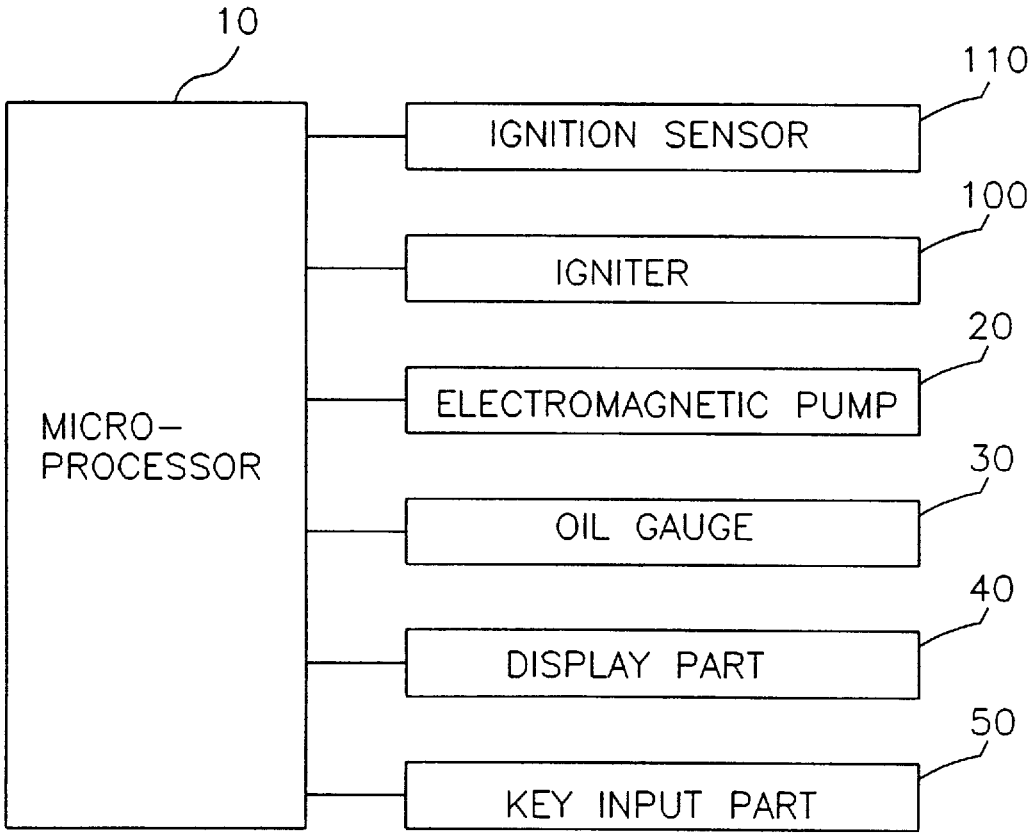
FIG. 2 is a block diagram of a display apparatus for a possible remaining time of a combustion operation according to the present invention.

FIG. 2 is a block diagram of a display apparatus for a possible remaining time of combustion operation according to the present invention. The present invention will be described with reference to FIG. 1, too. The apparatus for displaying a possible remaining time of combustion operation has a microprocessor 10 for controlling the overall operation of the combustion appliance, an electromagnetic pump 20 for drawing the fuel 80 in the fuel tank 90 and supplying it to the burner 65, an igniter 100 for executing ignition operation of the fuel supplied into the burner 65, and an oil gauge 30 for gauging a quantity of the fuel 80 in the fuel tank 90. A key input part 50 is connected to an input port of the microprocessor 10, and a display part 40 is connected to an output port of the microprocessor 10. The user inputs commands for the operation of the combustion appliance through the key input part 50. The display part 40 displays the possible remaining time of combustion operation calculated by the microprocessor 10. The display part may be implemented by an analog-type device, and preferably it is implemented by digital-type device like seven-segment device.

The oil gauge 30 gauges the quantity of the residual fuel 80 in the fuel tank 90, and transfers the signals about the gauged quantity to the microprocessor 10. As for the oil gauge 30, a float-type oil gauge which uses floater moving upwardly or downwardly according the quantity of the fuel 80, or an electromagnetic-type oil gauge which generates electric signals according to the quantity of the fuel 80 can be adopted. The microprocessor 10 senses the quantity of the residual fuel 80 according to the signals transferred from the oil gauge 30.

The heat amount per quantity of the fuel 80 has been inputted into the microprocessor 10, and the microprocessor 10 calculates the total heat amount of the residual fuel 80 by multiplying the quantity of the residual fuel 80 gauged from the oil gauge 30 by the heat amount per quantity of the fuel 80.

The electromagnetic pump 20 is driven with a certain frequency so that it supplies the fuel 80 in the fuel tank 90 into the burner 65. During that situation, the fuel supply quantity per time is proportional to the driving frequency of the electromagnetic pump 20. That is, if the heating intensity is varied by the operation of the user, the microprocessor 10 varies the driving frequency of the electromagnetic pump 20. Accordingly, the heat supply amount per time by the electromagnetic pump 20 is increased or decreased proportionally to the driving frequency thereof. For instance, if the driving frequency of the electromagnetic pump 20 is 6 Hz the heat supply amount per hour is about 4000 kcal, and if the driving frequency of the electromagnetic pump 20 is 20 Hz the heat supply amount per hour is about 15000 kcal. Said heat supply amount per hour may differ according to the kind of the fuel and the electromagnetic pump 20.

Figure 3:
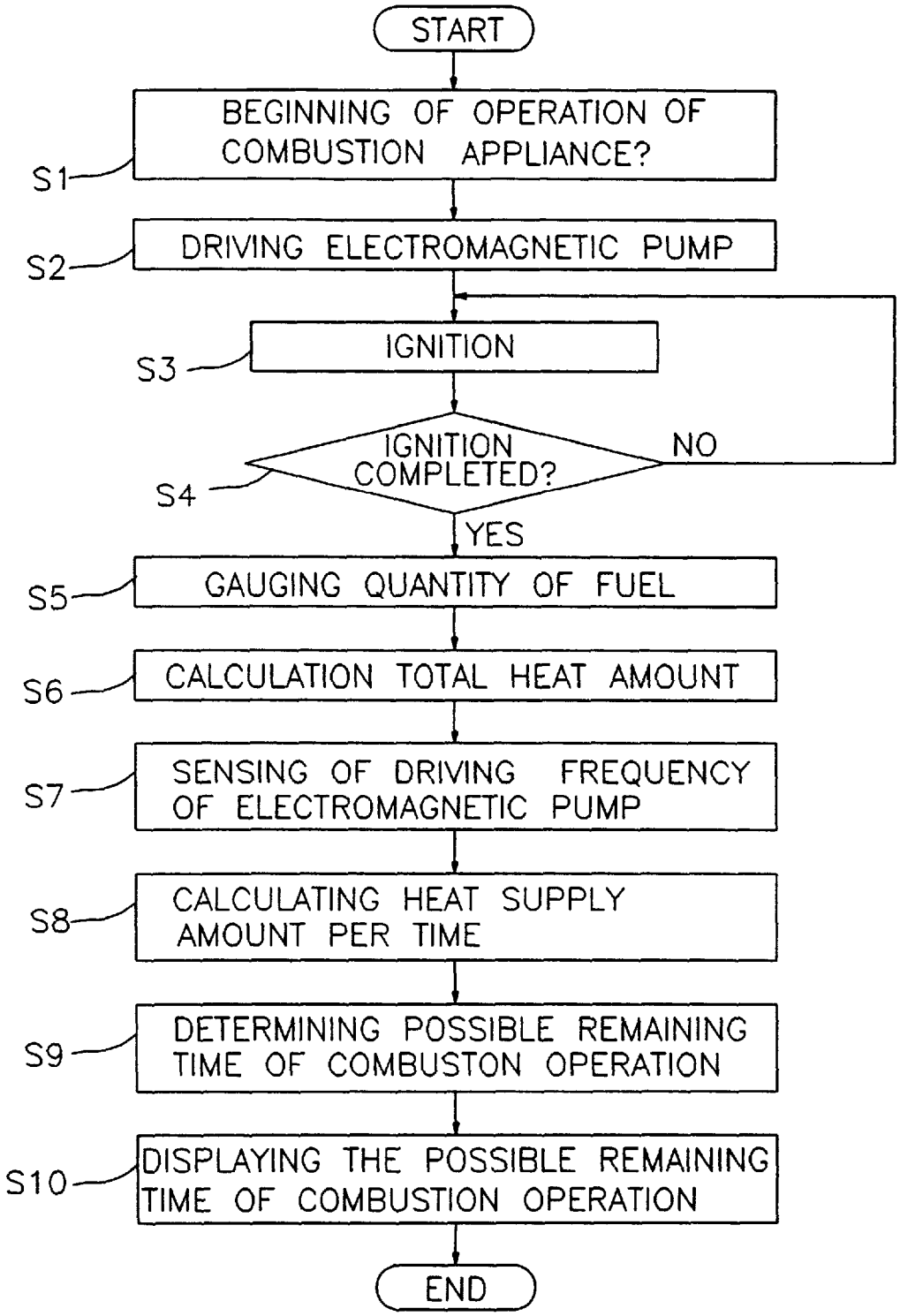
FIG. 3 is a flow chart for a method for displaying a possible remaining time of a combustion operation according to the present invention.

Hereinafter, the method for displaying the possible remaining time of combustion operation according to the present invention will be described with reference to FIG. 3. When the user begins to operate the combustion appliance by the operation of the key input part 50, the microprocessor 10 senses this situation S1 and supplies the fuel 80 into the burner 65 by driving the electromagnetic pump 20 S2. At that time, the driving frequency of the electromagnetic pump 20 is determined according to the heating intensity set by the user. Thereafter, the microprocessor 10 drives the igniter 100 for ignition operation S3 and senses the ignition through the ignition sensor 110 S4. If the ignition is not completed the microprocessor 10 executes the ignition operation again S3, but if the ignition is completed the microprocessor 10 gauges the quantity of the residual fuel 80 in fuel tank 90 through the oil gauge 30 S5. The microprocessor 10 calculates the total heat amount according to the residual fuel 80 by multiplying the gauged quantity of the residual fuel 80 by the heat amount per quantity of the fuel 80 S6. The microprocessor 10 senses the driving frequency of the electromagnetic pump 20 S7. The driving frequency of the electromagnetic pump 20 is set to correspond to the heating intensity set by the user at the beginning of operation of the combustion appliance, and if the heating intensity is varied by the user, it is set to correspond to the varied heating intensity. The microprocessor 10 calculates the heat supply amount per time on the basis of the driving frequency S8. The heat supply amount per time is, as described above, can be different according to the kind of fuel 80 and the electromagnetic pump 20, and the information about them is pre-inputted to the microprocessor 10. The microprocessor 10 calculates the possible remaining time of combustion operation by dividing the calculated total heat amount by the heat supply amount per time S9. For instance, if the total heat amount according to the quantity of the residual fuel 80 is 20000 kcal and the heat supply amount per time is 6000 kcal/h, the possible remaining time of combustion operation which is calculated by dividing the total heat amount by the heat supply amount per time is about 3.34 hours. The calculated time is displayed on the exterior of the combustion appliance through the display part 40 S10.

In this embodiment, although the total heat amount is calculated according to the quantity of the residual fuel 80 and the possible remaining time of the combustion operation is calculated by dividing the total heat amount by the heat supply amount per time, it is possible to calculate the possible remaining time of the combustion operation by dividing the gauged quantity of the residual fuel 80 by a fuel supply quantity per time. In this situation, the microprocessor 10 calculate the fuel supply quantity per time of the fuel 80 supplied into the burner 65 on the basis of the driving frequency of the electromagnetic pump 20.

According to the present invention, as the possible remaining time of the combustion operation by the residual fuel 80 is displayed during the operation of the combustion appliance, the use of the combustion appliance can be done more conveniently. Particularly, the heat supply amount per time is calculated exactly because it is calculated on the basis of the driving frequency of the electromagnetic pump 20, and accordingly, it is possible to calculate the possible remaining time of the combustion operation exactly.

Although the present invention has been described and illustrated in detail, it is clearly understood that the same is by way of illustration and example only and is not to be taken by way of limitation, wherein the spirit and scope of the present invention is limited only by the terms of the appended claims.

What is claimed is:

1. A method of displaying a possible remaining time of a combustion operation in a combustion appliance which has a fuel tank for containing a fuel, a burner for performing the combustion operation of the fuel supplied from said fuel tank, and an electromagnetic pump for supplying the fuel in said fuel tank to said burner, comprising the steps of:

gauging a quantity of the fuel in said fuel tank;

calculating a fuel supply quantity per time of the fuel supplied to said burner on the basis of a driving frequency of said electromagnetic pump;

determining the possible remaining time of the combustion operation according to the quantity of the fuel and the fuel supply quantity per time; and displaying the possible remaining time of the combustion operation.

2. The method of displaying a possible remaining time of a combustion operation in a combustion appliance as claimed in claim 1, wherein the fuel supply quantity per time is proportional to the driving frequency of the electromagnetic pump.

3. The method of displaying a possible remaining time of a combustion operation in a combustion appliance as claimed in claim 1, further comprising a step of sensing the combustion operation of said burner, p1 wherein the step of displaying is carried out when the combustion operation of said burner is being performed.

4. A method of displaying a possible remaining time of a combustion operation in a combustion appliance which has a fuel tank for containing a fuel, a burner for performing the combustion operation of the fuel supplied from said fuel tank, and an electromagnetic pump for supplying the fuel in said fuel tank to said burner, comprising the steps of:

sensing the combustion operation of said burner;

gauging a quantity of the fuel in said fuel tank;

calculating a total heat amount according to the quantity of the fuel;

calculating a heat supply amount per time of the fuel supplied to said burner on the basis of a driving frequency of the electromagnetic pump;

determining the possible remaining time of the combustion operation according to the total heat amount and the heat supply amount per time; and displaying the possible remaining time of the combustion operation according to the sensing of the combustion operation.

5. An apparatus of displaying a possible remaining time of a combustion operation in a combustion appliance which has a fuel tank for containing a fuel, a burner for performing the combustion operation of the fuel supplied from said fuel tank, and an electromagnetic pump for supplying the fuel in said fuel tank to said burner, comprising:

a fuel quantity gauging part for gauging a quantity of the fuel in said fuel tank;

a calculation part for calculating a fuel supply quantity per time of the fuel supplied to said burner on the basis of a driving frequency of said electromagnetic pump and determining the possible remaining time of the combustion operation according to the quantity of the fuel and the fuel supply quantity per time; and a display part for displaying the possible remaining time of the combustion operation.

6. The apparatus of displaying a possible remaining time of a combustion operation in a combustion appliance as claimed in claim 5, wherein said calculation part calculates the fuel supply quantity per time proportionally to the driving frequency of said electromagnetic pump.

7. The apparatus of displaying a possible remaining time of a combustion operation in a combustion appliance as claimed in claim 5, further comprising an ignition sensing part sensing the combustion operation of said burner, wherein said displaying part displays the possible remaining time of the combustion operation when the combustion operation of said burner is being performed.

* * * * *